US011622611B2

(12) United States Patent
Depoyian

(10) Patent No.: US 11,622,611 B2
(45) Date of Patent: Apr. 11, 2023

(54) HAIR DRYER APPARATUS

(71) Applicant: Jacques Depoyian, Denver, CO (US)

(72) Inventor: Jacques Depoyian, Denver, CO (US)

( * ) Notice: Subject to any disclaimer, the term of this patent is extended or adjusted under 35 U.S.C. 154(b) by 79 days.

(21) Appl. No.: 17/314,037

(22) Filed: May 6, 2021

(65) Prior Publication Data

US 2021/0345750 A1 Nov. 11, 2021

Related U.S. Application Data

(60) Provisional application No. 63/021,105, filed on May 7, 2020.

(51) Int. Cl.
*A45D 20/12* (2006.01)

(52) U.S. Cl.
CPC ..... *A45D 20/12* (2013.01)

(58) Field of Classification Search
CPC ..... A45D 20/00; A45D 20/12
USPC ..... 34/95–100
See application file for complete search history.

(56) References Cited

U.S. PATENT DOCUMENTS 4,706,326 A * 11/1987 Romani ..... A45D 20/52 15/345
5,832,624 A * 11/1998 Narrin ..... F16M 13/00 34/97
6,067,724 A * 5/2000 Depoyian ..... A45D 20/12 392/383
6,199,295 B1 * 3/2001 Smal ..... A45D 20/122 34/98
6,755,278 B2 * 6/2004 Huhn ..... D06F 58/20 181/202
8,707,577 B2 * 4/2014 Lee ..... A45D 20/12 34/100
9,980,549 B2 * 5/2018 Sakuma ..... A45D 20/12
10,143,284 B2 * 12/2018 Depoyian ..... A45D 20/50
10,660,487 B1 * 5/2020 Borja ..... A45D 20/16
2021/0219694 A1 * 7/2021 Zhou ..... G06T 7/194
2021/0345750 A1 * 11/2021 Depoyian ..... A45D 20/12

FOREIGN PATENT DOCUMENTS

DE 3529410 A1 * 2/1987
GB 2515813 A * 1/2015 ..... A45D 20/00
WO WO-2013144572 A1 * 10/2013 ..... A45D 20/00

* cited by examiner

*Primary Examiner* — Stephen M Gravini
(74) *Attorney, Agent, or Firm* — Roger A. Jackson

(57) ABSTRACT

A hair dryer apparatus includes a housing with a surrounding sidewall having an inner surface defining an interior and an opposing outer surface, further the sidewall having an inlet and an opposing outlet. In addition, the hair dryer apparatus includes a motor driven blower disposed within the interior, the blower drives airflow from the inlet to the outlet. Additionally, the hair dryer apparatus includes a handle extending from the sidewall and a suction shroud that includes a solid base with an outer surrounding sidewall extending from the base, wherein the outer surrounding sidewall has an outer termination portion that is scarfed such that the outer termination portion extends from the base to offset lengths toward the sidewall outlet thus ultimately the blower suction being adjacent to the sidewall outlet for noise attenuation and reducing user hair entanglement in the blower suction.

3 Claims, 19 Drawing Sheets

HAIR DRYER APPARATUS

RELATED PATENT APPLICATION

This application claims the benefit of U.S. provisional patent application Ser. No. 63/021,105 filed on May 7, 2020 by Jacques Depoyian of Denver, Colo., U.S.

TECHNICAL FIELD

The present invention relates generally to a hair dryer apparatus that is hand held for the purpose of drying human hair. More particularly, the present invention of the portable hair dryer apparatus has a front air suction to reduce user hair entanglement and have noise attenuation features.

BACKGROUND OF INVENTION

Hair dryers that are portable and hand-held typically have two classifications, a first classification being for personal individual use and a second for professional salon use. The personal use hair dryer is usually used once daily in a person's home, wherein the design objective is primarily low cost resulting in minimal features suitable for the occasional use of the hair dryer by the individual. Thus, the personal hair dryer would have a simple fixed integral handle, no removably engagable brush attachments, lack any provision for sound attenuation, and further usually no effort is put into having an ergonomic handle that is designed to balance the center of gravity of the hair dryer for minimal hand and wrist fatigue.

Wherein, with the second classification for the professional hair dryer that would be typically used 30 or so times a day by the same stylist in a salon environment with numerous other stylists, thus using the hair dryer at a rate of about 30 times of what the personal hair dryer would be used by an individual. Thus, a number of additional factors come into play with the professional hair dryer, such as usage durability, hand and wrist stress/fatigue with holding and using the hair dryer many times per day in having issues similar to the well-known carpal-tunnel syndrome from a high number of repetitive hand and wrist motions, further the increased noise from up to 30 or so hair dryers operating simultaneously in the same environmental space can be also fatiguing as well as possibly causing hearing damage. As fan noise is primarily related to air velocity, such that higher velocity equals higher noise, which is what the personal hair dryers have to reduce costs, such that having smaller size air flow passageways reduces the housing size and cost while higher air velocity requires less heating element insulation also reducing cost, however, with the result that the hair dryer makes more noise. Thus the personal dryer outputs a high temperature flow of high velocity air that works well for what most personal users want being that the hair dryer is primarily a fast hair blow drying appliance and not primarily used for hair styling which would more encompass salon use.

Thus with the professional hair dryer, styling is more of a primary use, in desiring the removably engagable brushes, wherein slower drying of hair would also be desirable. Further, with the professional hair dryer an enhanced design could include features such as an ergonomically designed handle that through variable structure would be able to alter positional orientations as between the hair dryer outlet and the operator's hand and wrist to reduce fatigue of the hand and wrist. In addition, design could be done to attenuate the noise produced outside of the hair dryer enclosure or housing, and having removably engagable brushes for operator convenience to quickly and easily change brush types for hair styling. Naturally these enhancements to the professional hair dryer would add cost, however, it is anticipated that the professional operators or users would pay more for a value added product, being an analogy with mechanics tools, wherein the personal occasional tool user can get by with low quality low cost tools, wherein someone who makes their living using tools daily will benefit from higher quality tools and thus will pay for them.

In looking at the prior art in the hair dryer area, in U.S. Pat. No. 6,067,724 to Depoyian disclosed is a hair dryer that has interchangeable brush heads that are removably engagable to the dryer body, wherein the brush heads are hollow that allow the hair dryer air to flow therethrough the brush bristles, see FIGS. 1, 4, 8, and 9. In Depoyian, the hair dryer also can have a pivotable handle, see FIG. 11, that allows an electrical power wire through a slot to facilitate the handle pivotal movement in relation to the hair dryer body, see FIG. 14 with only the disclosed ability to lock the handle at only the in-line and right angle positions, see FIG. 2A. Further, in Depoyian the handle pivotal locks are structured to be V-shaped projections that are ninety degrees apart that are matched to a pair of recesses for the purpose of locking the pivotal handle in only the two positions only at the in-line and right angle, see FIGS. 11, 13, 14, and 15.

Further, in looking at the prior art in the hair dryer area, in U.S. Pat. No. 4,198,556 to Crowley, et al., disclosed is a hair-drying appliance having a cylindrical housing and a handle rotatably mounted at one end thereof for movement between a first position generally perpendicular to the housing and a second position in longitudinal alignment with the housing. In Crowley, a single locking lever is provided for latching the handle in either of its positions wherein the appliance has a first air outlet at one end of the cylindrical housing and a second air outlet in the side wall of the housing adjacent the first air outlet. Further, in Crowley an adaptor, which is mountable on the housing adjacent the second air outlet only when the handle is in its second aligned position, has a plate portion for blocking the first air outlet and means for supporting comb and brush attachments thereon. Crowley has a two position handle being for use as a pistol gun type handle arrangement or as an elongated straight bodied dryer only. Crowley also teaches multiple attachments for brushes and combs that the air can blow therethrough.

Continuing, in the portable hair dryer arts, in U.S. Pat. No. 3,846,047 to Wada, et al., disclosed is a foldable hair dryer consisting of a hollow nozzle assembly made up of a cylindrical portion and tangentially extending nozzle coaxially fitted into a handle assembly having a cylindrical portion and tangentially extending handle, the two assemblies being generally symmetrical. In Wada, the thickness of the nozzle, handle and their associated cylindrical portions, measured axially, is approximately the same resulting in a compact, "flat" construction, see in particular FIG. 3.

Further in Wada, within the cylindrical portion of the nozzle assembly is mounted a motor and fan assembly also of "flat" configuration in which the blades of the fan are peripherally disposed about the motor wherein the nozzle is fitted with a heating element. The nozzle and handle assemblies in Wada are coaxially pivoted for movement between an operating condition, see FIG. 2 in which the nozzle and handle are in "L" configuration and a collapsed condition in which the nozzle and handle lie compactly side by side, see FIG. 3. Also, in Wada a switch on the handle is operated by the nozzle incident to the collapsing movement to insure that the motor and heating element are both turned off in the collapsed state, again see FIGS. 2 and 3. Thus in Wada the hair dryer is only foldable for portability purposes.

Moving onward in the portable hair dryer arts, in U.S. Pat. No. 8,813,384 to Correll, Jr., et al., disclosed is a hair dryer having a handle that may both be pivoted toward the dryer housing, and rotated with respect to the dryer housing so that the dryer may easily be operated in either a handle-held or nozzle-held mode, wherein the handle has two pivotal axes of movement. The hair dryer in Correll includes a dual axis joint assembly connecting the handle to the dryer housing that allows the handle to be rotated around its longitudinal axis before or during the time it is pivoted toward the dryer housing so that the control switch remains exposed and operable by a user when the handle is pivotally folded against the dryer body in preparation for nozzle-held operation, see FIGS. 6, 7, 11A, and 11B.

The dual axis joint assembly in Correll may include an eccentric mechanism that converts pivoting movement of the handle toward and away from the housing into rotational movement of said handle so that the handle turns 90 degrees when pivotally folded against the dryer housing, see the pictorial sequence in going from FIGS. 10 to 11A to 11B to 12. Additionally, Correll has the electrical cord connection for supplying power to the blower assembly within the dryer housing is mounted on the blower assembly portion of the housing opposite the nozzle instead of on the handle so that the electrical cord does not interfere with the nozzle held operation of the dryer, see FIG. 10. The primary advantage that Correll teaches is the adjustable movement of the control switches through handle rotational movement that is convenient when assuming different hand hold positions about the handle.

Next, in the portable hair dryer appliance arts specifically relating to noise reduction, in U.S. Pat. No. 8,307,948 to Parodi disclosed is a noise silencer device for a hair dryer that comprises a container structure exhibiting a plurality of inlet openings, an outlet opening, and a conduit connecting the inlet and outlet openings to one another and further comprising a ring made of sound-absorbent material that is inserted in the conduit such as to interfere with a flow of air between the inlet openings and the outlet opening in such a way as to at least partly attenuate sound vibrations associated to the air flow. The inlet openings in Parodi are made on a lateral wall of the container structure and face the axis such as to define an air flow along a first transversal direction to the axis such as to define a flow of air along a first transversal direction to the axis, and deviating means arranged in the conduit impress an axial deviation along the axis on the air flow coming from the inlet openings. Thus Parodi utilizes sound attenuation with enclosure modifications as opposed to reducing sound at the root source, wherein the teaching is strictly related to the inlet of the hair dryer via dampening noise vibrations within the inlet housing.

Further, in the hair dryer arts, again specifically relating to noise reduction, in U.S. Pat. No. 6,011,903 to Nosenchuck, disclosed an axial flow hair dryer that comprises a generally circular main housing with a transitional portion that smoothly reduces the housing diameter to an outlet. Nosenchuck has a first fan stage in the main housing generates an axial air flow through the housing, wherein an outer duct has two axial extensions secured to the housing near the beginning of the transitional portion, and the housing air outlet introduces air exiting the housing into the outer duct. The housing in Nosenchuck and the outer ducts form two additional ambient air intakes extending between the axial extensions in a smooth arc toward the main housing outlet with a second fan stage that includes a second axial flow impeller in the outer duct for generating air flow through the ambient air intake.

In Nosenchuck, the second axial flow impeller includes inner and outer blades separated by an annular shroud that forms an extension of the main housing flow passage. A guide duct in Nosenchuck, being in the outer duct forms a further extension of the extended air flow passage, and the guide duct includes stator vanes at its outlet. Further, Nosenchuck has a handle depending from the main housing that holds a motor and a flex shaft that connects the motor to a drive shaft that carries both fan stages. In addition, Nosenchuck has resistance heating wires in the main housing heat the air flowing through the hair dryer. Nosenchuck increases the mass flow rate of air via a two stage axial fan, thus reducing the need for higher rotating speed fans which of course helps keep the noise down.

What is needed is a hair dryer apparatus that is specifically designed for the professional salon user market having a balanced handle, that has a balanced center of gravity design both for minimizing hand and wrist fatigue during frequent repeated uses. Plus noise attenuation features for facilitating a more pleasing environment wherein numerous portable hair dryers are in use simultaneously in the same environmental space, such as in a salon with the air suction positioned toward the front to minimize user hair entanglement and reduce noise through diffused air suction ports.

SUMMARY OF INVENTION

Broadly, the present invention is a hair dryer apparatus that includes a housing with a surrounding sidewall that is about a longitudinal axis, the surrounding sidewall having an inner surface portion defining a sidewall interior and the surrounding sidewall having an opposing outer surface portion, further the surrounding sidewall having an inlet portion and an opposing outlet portion with the longitudinal axis spanning therebetween. In addition, the hair dryer apparatus includes a motor driven blower disposed within the surrounding sidewall interior; the blower is operational to drive airflow from the inlet portion therethrough the sidewall interior to the outlet portion.

Further the hair dryer apparatus includes a suction shroud that includes a solid base with an outer surrounding sidewall extending from the base, wherein the outer surrounding sidewall has an outer termination portion that is scarfed such that the outer termination portion extends from the base to offset lengths, further included is an inner surrounding sidewall that is positioned to be inwardly adjacent to the outer surrounding sidewall to form a gap as between the inner and outer surrounding sidewalls that is fixed by a guide vane affixed and disposed as between the inner and outer surrounding sidewalls. The inner surrounding sidewall has an inner termination portion that substantially matches the outer termination portion in a profile, further the inner surrounding sidewall extends to an annular termination portion in an opposite direction to the inner termination portion, the annular termination portion forms an annular channel with the solid base and an aperture defined by an inner margin. Wherein the inner margin is attached to the inlet portion such that the annular channel to facilitate fluid communication from the gap, to the annular channel, to said inlet portion to operationally redirect the air suction about one-hundred and eighty (180) degrees toward the outlet portion to re-direct air suction noise away from the inlet portion to reduce air suction noise for a user facing said inlet portion during use of the hair dryer and to reduce the chance of user hair entanglement with the air suction being directed away from the housing inlet portion toward the housing outlet portion.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
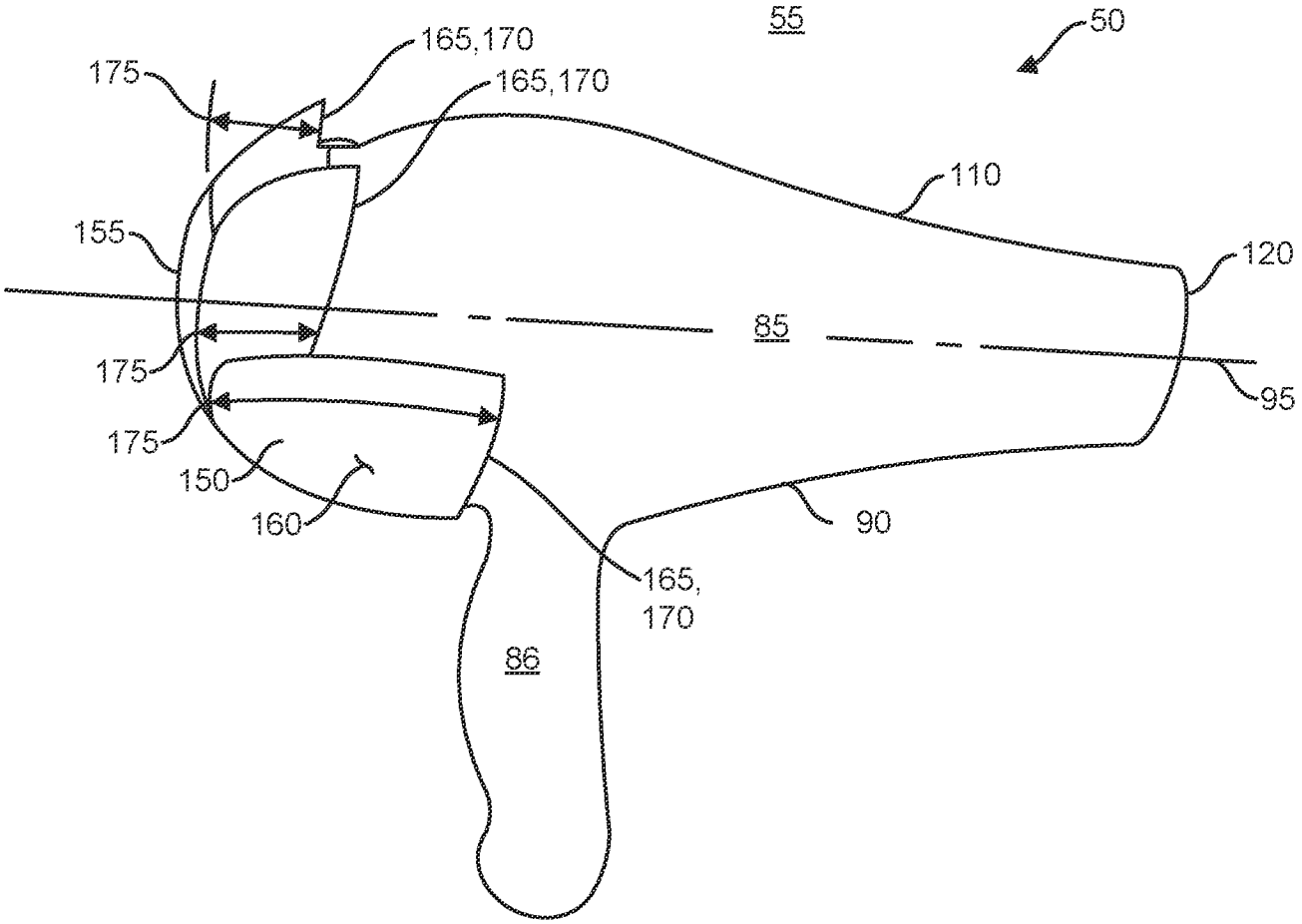
FIG. 1 shows a side elevation view of the hair dryer apparatus that includes the housing, the handle that is in the perpendicular position of the longitudinal axis of the surrounding sidewall, the inlet and outlet portions of the surrounding sidewall, and the suction shroud.

50 Hair dryer apparatus
55 External environment
60 User
65 Hair of the user 60
70 Potential hair 65 entanglement of the user 60 in the hair dryer apparatus 50 surrounding sidewall inlet portion 115
75 Heater element
85 Housing
86 Handle extending from the housing 85
90 Surrounding sidewall of the housing 85
95 Longitudinal axis of the surrounding sidewall 90
100 Inner surface portion of the surrounding sidewall 90
105 Interior of the surrounding sidewall 90
110 Outer surface portion of the surrounding sidewall 90
115 Inlet portion of the surrounding sidewall 90
120 Outlet portion of the surrounding sidewall 90
125 Motor

130 Blower

131 Airflow of the motor 125 and blower 130

132 Forming an air suction

135 Air flow suction therethrough the sidewall interior 105

140 Forming air discharge at the outlet portion 120

145 Fluid communication from the external environment 55 to the sidewall interior 105

150 Suction shroud

155 Solid base of the suction shroud 150

160 Outer surrounding sidewall of the suction shroud 150

165 Outer termination portion of the outer surrounding sidewall 160

170 Scarfed portion of the outer termination portion 165

175 Outer termination portion that extends from the base 155 to offset lengths

180 Inner surrounding sidewall of the suction shroud 150

185 Gap formed between the inner 180 and outer 160 surrounding sidewalls

190 Guide vane disposed between the inner 180 and outer 160 surrounding sidewalls to provide structural support for the annular channel 210

195 Inner termination portion of the inner surrounding sidewall 180

200 Profile match as between the inner termination portion 195 and the outer termination portion 165

205 Annular termination portion of the inner surrounding sidewall 180

210 Annular channel of the annular termination portion 205

215 Aperture defined by an inner margin

220 Fluid communication from the gap 185 to the annular channel 210 to the inlet portion 115 to operationally redirect the air suction 135 about one-hundred eighty degrees toward the outlet portion 120 to redirect air suction noise away from the inlet portion 115 to reduce air suction noise for the user 60 and reduce the chance of hair 65 entanglement 70 of the user 60 that would exist with a prior art air suction at the inlet portion 115 as opposed to the present invention having air suction at the outlet portion 120

300 Alternate hair dryer apparatus

305 Potential hair 65 entanglement of the user 60 in the alternate hair dryer apparatus 300 alternate surrounding sidewall inlet portion 340

310 Alternate housing

311 Handle first portion extending from the alternate housing 310

315 Alternate surrounding sidewall of the alternate housing 310

320 Alternate longitudinal axis of the alternate surrounding sidewall 315

325 Alternate inner surface portion of the alternate surrounding sidewall 315

330 Alternate interior of the alternate surrounding sidewall 315

335 Alternate outer surface portion of the alternate surrounding sidewall 315

340 Alternate inlet portion of the alternate surrounding sidewall 315

345 Alternate outlet portion of the alternate surrounding sidewall 315

350 Alternate motor

355 Alternate blower

360 Alternate airflow of the alternate motor 350 and alternate blower 355

365 Alternate forming an air suction

370 Alternate air flow suction therethrough the alternate sidewall interior 330

375 Alternate forming air discharge at the alternate outlet portion 345

380 Alternate fluid communication from the external environment 55 to the alternate sidewall interior 330

385 Alternate suction shroud

390 Handle second portion extending from the alternate suction shroud 385

400 Alternate solid base of the alternate suction shroud 385

405 Alternate solid base inner face of the alternate suction shroud 385

410 Alternate solid base outer face of the alternate suction shroud 385

415 Alternate outer surrounding sidewall of the alternate suction shroud 385

420 Alternate outer termination portion of the alternate suction shroud 385

425 Alternate partial annular aperture opening of the alternate suction shroud 385

430 Alternate outer boundary of the alternate suction shroud 385

435 Alternate inner boundary of the alternate suction shroud 385

440 Alternate annular flow path of the alternate suction shroud 385

445 Alternate inlet chamber of the alternate suction shroud 385

500 Removably engagable electrical plug assembly

505 Male insert element of lock assembly 500

506 Male receptacle axis

510 Female receptacle element of lock assembly 500

511 Female receptacle axis

515 Insert 505 axial movement along the male receptacle axis 506 to go from the separated state 595 to the assembled state 600

516 Insert 505 axial movement along the male receptacle axis 506 to go from the assembled state 600 to the separated state 595

520 First clamshell retainer

525 Second clamshell retainer

530 Protrusion of the female insert element 510

535 First female electrically conductive element of the protrusion 530

540 Second female electrically conductive element of the protrusion 530

545 Female annular cavity defined by the female cylinder 550 and protrusion 530

550 Female cylinder that defines the female annular cavity 545

555 Male cylinder of the male inert element 505, wherein the male cylinder 555 is received into the female annular cavity 545

556 Male cavity of the male insert element 505, wherein the male cavity receives the protrusion 530

560 First male electrically conductive element disposed within the male cylinder 555

565 Second male electrically conductive element disposed within the male cylinder 555

570 First electrical communication conductor contact between the first female electrically conductive element 535 and the first male electrically conductive element 560

575 Second electrical communication conductor contact between the second female electrically conductive element 540 and the second male electrically conductive element 565

580 Distal end portion of the handle 86 or alternate handle 311 of the hair dryer apparatus 50 or alternate hair dryer apparatus 300

581 Longwise axis of the handle 86 or 311

585 Inner void of the distal end portion of the handle 580

590 First clamshell retainer 520 and second clamshell retainer 525 retaining the female receptacle element 510 within the inner void 585 via frictional contact

595 Separated state of the male insert element 505 of lock assembly 500 and the female receptacle element 510 of lock assembly 500

600 Assembled state of the male insert element 505 of lock assembly 500 and the female receptacle element 510 of lock assembly 500

605 Removably engagable interface of alternate solid base 400 to the intermediate connection ring 610

610 Intermediate connection ring between the alternate solid base 400 and the alternate suction shroud 385

DETAILED DESCRIPTION

Figure 2:
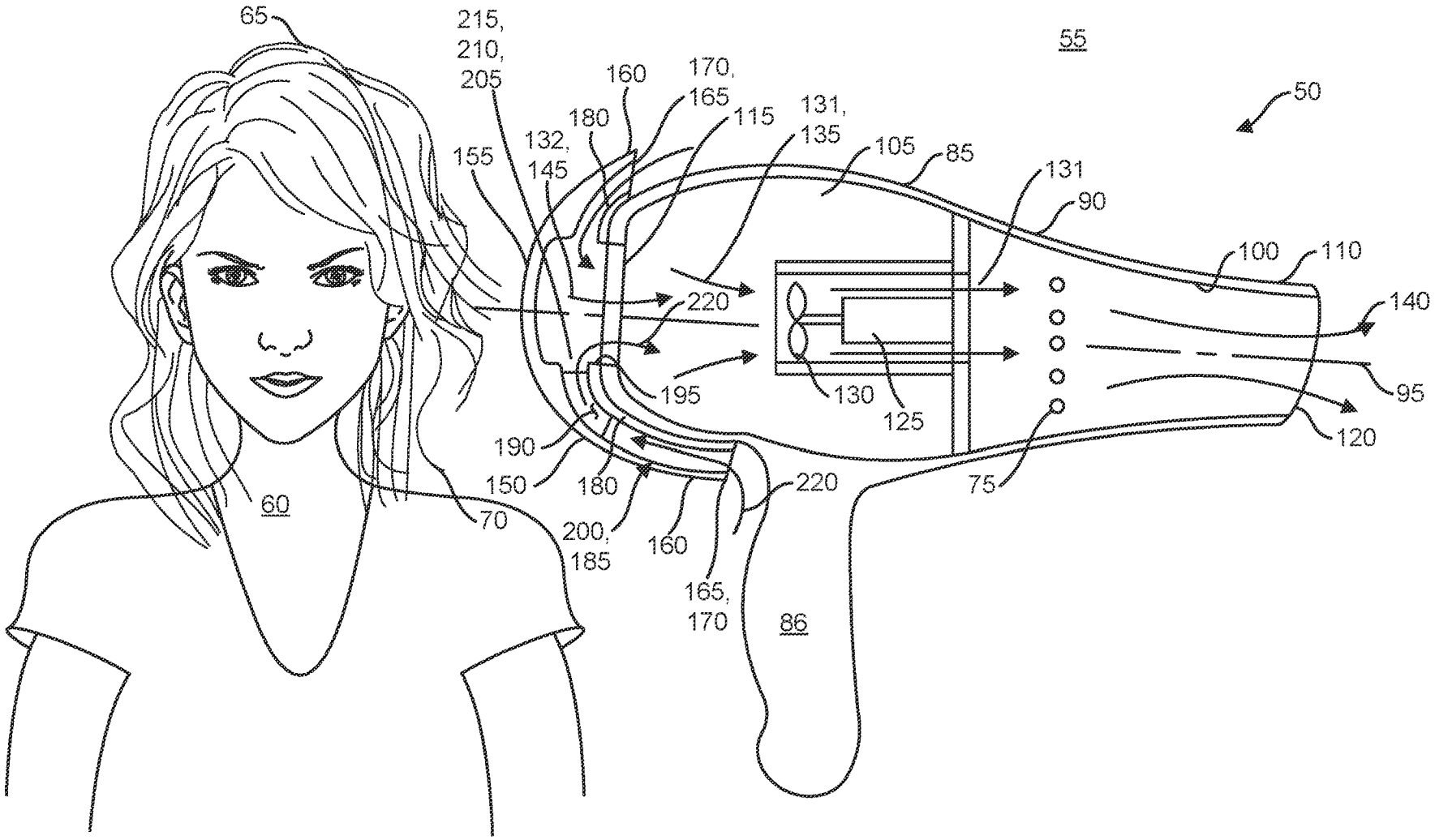
FIG. 2 shows a side elevation view of the hair dryer apparatus in cross section that includes the housing, the handle, the inlet and outlet portions of the surrounding sidewall, and the suction shroud showing how the front suction of the scarfed outer termination portion reduces air suction hair entanglement of the user's hair, further the motor, blower, and heater element are also shown.
Figure 3:
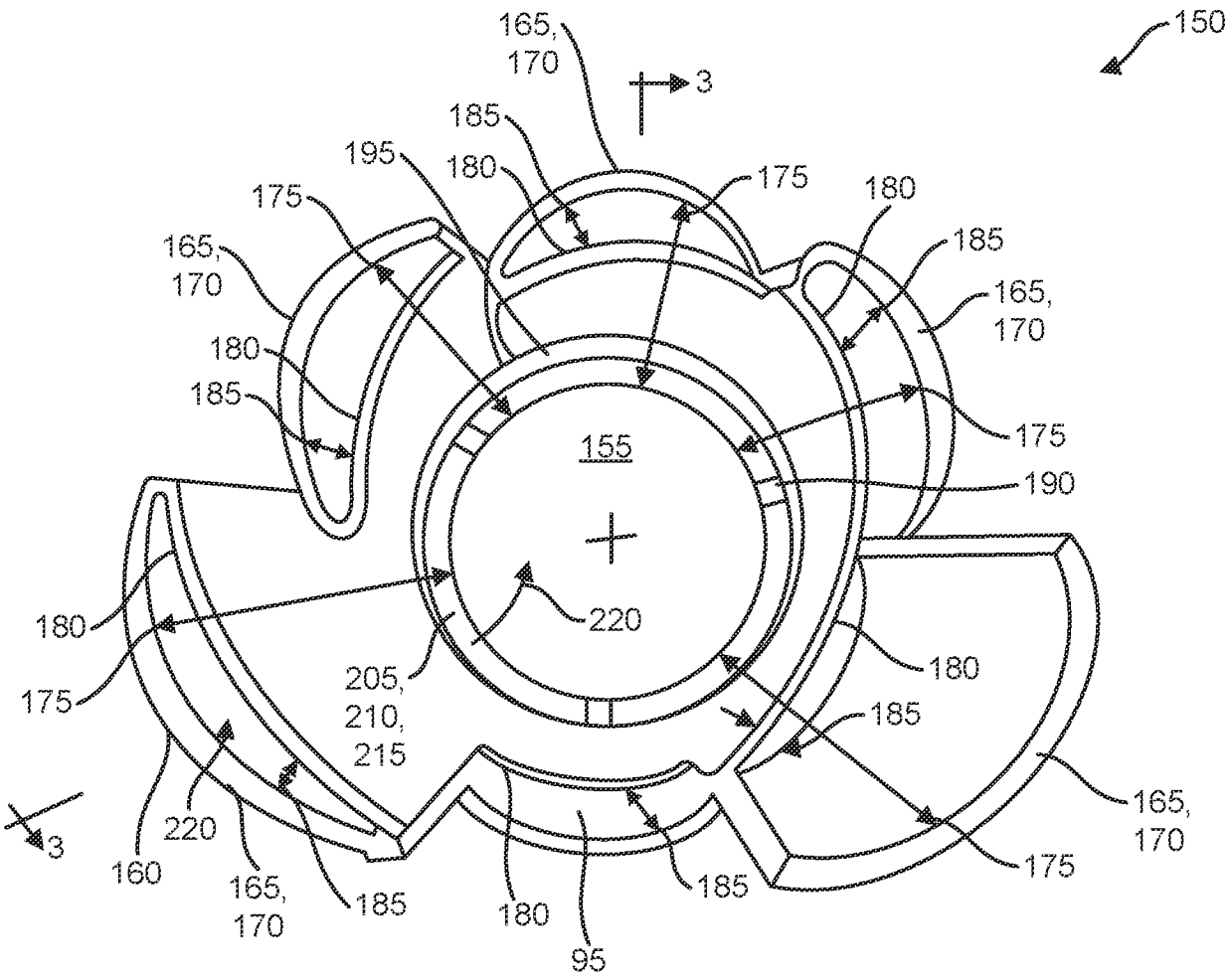
FIG. 3 shows a suction side elevation view of the suction shroud with the scarfed portion of the outer termination portion and the gap between the inner and outer surrounding sidewalls, plus the solid base.

With initial reference to FIG. 1 shown is a side elevation view of the hair dryer apparatus 50 that includes the housing 85, the handle 86 that is in the perpendicular position to the longitudinal axis 95 of the surrounding sidewall 90, the inlet 115 and outlet 120 portions of the surrounding sidewall 90, and the suction shroud 150;

Next, FIG. 2 shows a side elevation view of the hair dryer apparatus 50 in cross section that includes the housing 85, the handle 86, the inlet 115 and outlet 120 portions of the surrounding sidewall 90, and the suction shroud 150 showing how the front suction of the scarfed outer termination portion 170 reduces sucking hair entanglement 70 of the user's 60 hair 65, further the motor 125, blower 130, and heater element 75 are also shown;

Further, FIG. 3 shows a suction side elevation view of the suction shroud 150 with the scarfed portion of the outer termination portion 170 and the gap 185 between the inner 180 and outer 160 surrounding sidewalls, plus the solid base 155.

Figure 4:
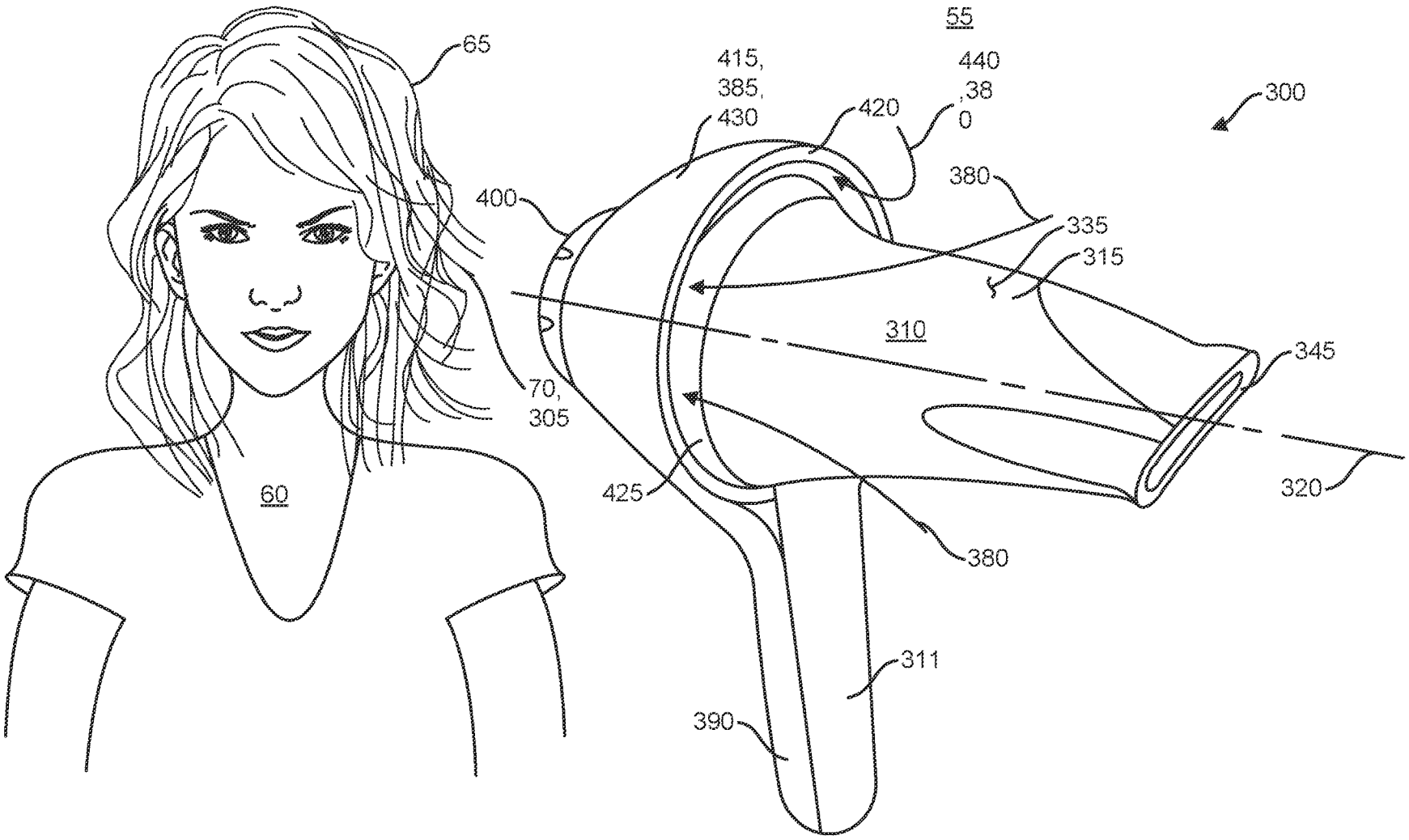
FIG. 4 shows a perspective view of the alternate hair dryer apparatus that includes the housing, the handle, the alternate outlet portion of the alternate surrounding sidewall, and the alternate suction shroud showing the alternate annular aperture how the front suction of the alternate annular aperture reduces air suction hair entanglement of the user's hair.

Continuing, FIG. 4 shows a perspective view of the alternate hair dryer apparatus 300 that includes the alternate housing 310, the handle 311, 390, the alternate outlet portion 345 of the alternate surrounding sidewall 315, and the alternate suction shroud 385 showing the alternate annular aperture 425 how the front suction of the alternate annular aperture 425 reduces sucking hair entanglement 70 of the user's 60 hair 65.

Figure 5:
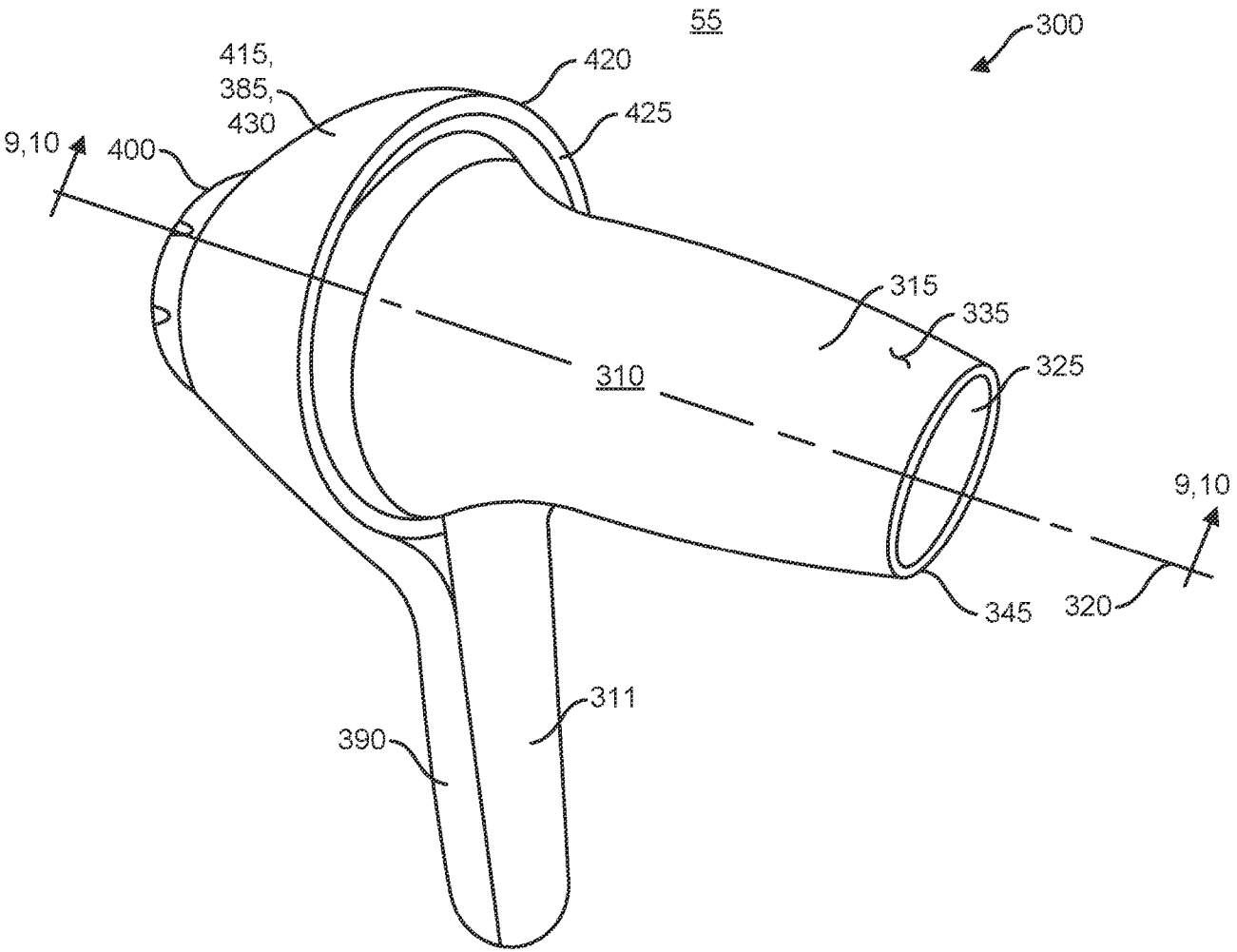
FIG. 5 shows a perspective view of the alternate hair dryer apparatus that includes the housing, the handle, the alternate outlet portion of the alternate surrounding sidewall, and the alternate suction shroud showing the alternate annular aperture.

Further, FIG. 5 shows a perspective view of the alternate hair dryer apparatus 300 that includes the alternate housing 310, the handle 311, 390, the alternate outlet portion 345 of the alternate surrounding sidewall 315, and the alternate suction shroud 385 showing the alternate annular aperture 425.

Figure 6:
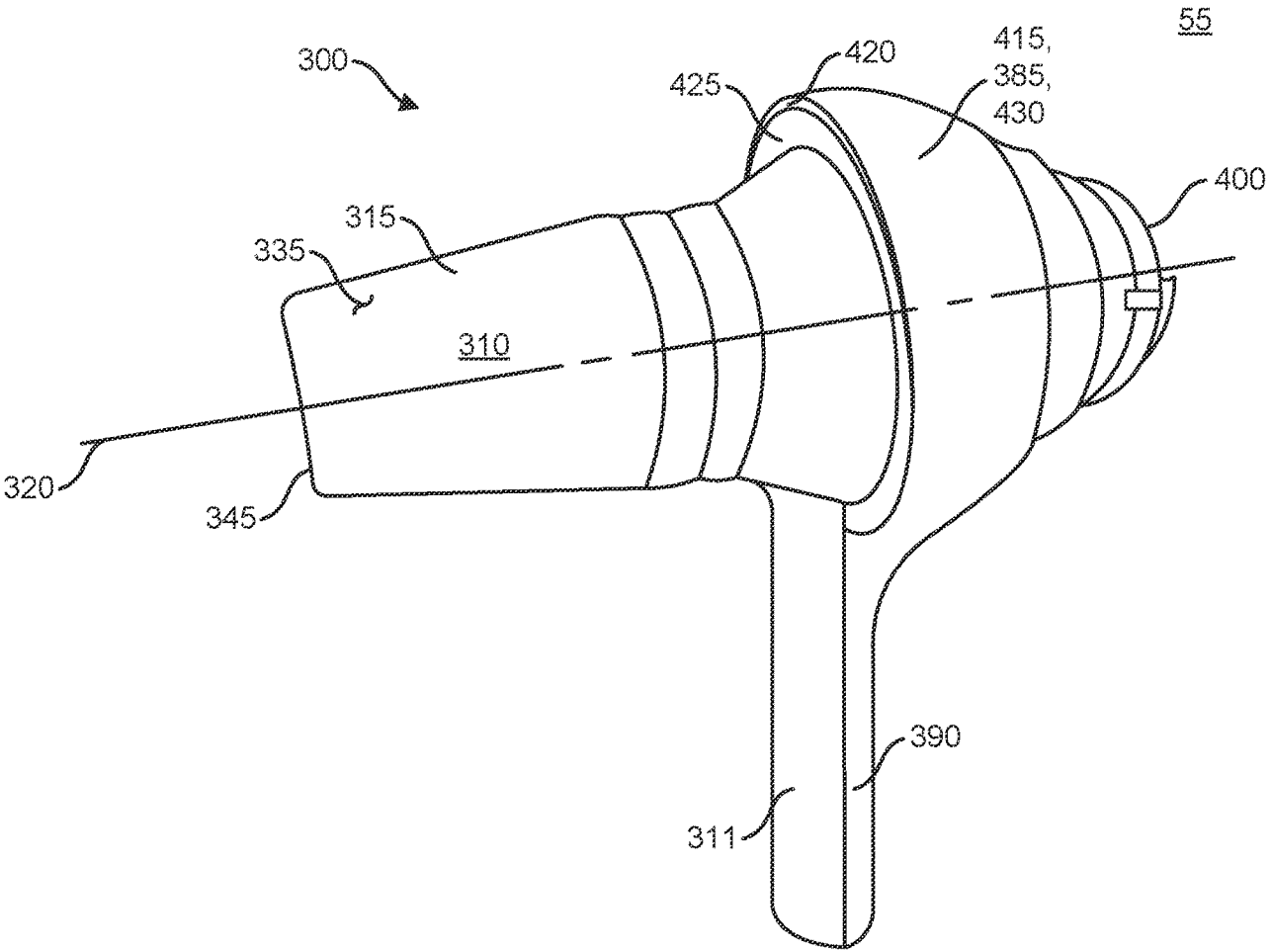
FIG. 6 shows a reverse perspective view of FIG. 5, with FIG. 6 showing the alternate hair dryer apparatus that includes the housing, the handle, the alternate outlet portion of the alternate surrounding sidewall, and the alternate suction shroud showing the alternate annular aperture.

Continuing, FIG. 6 shows a reverse perspective view of FIG. 5, with FIG. 6 showing the alternate hair dryer apparatus 300 that includes the alternate housing 310, the handle 311, 390, the alternate outlet portion 345 of the alternate surrounding sidewall 315, and the alternate suction shroud 385 showing the alternate annular aperture 425.

Figure 7:
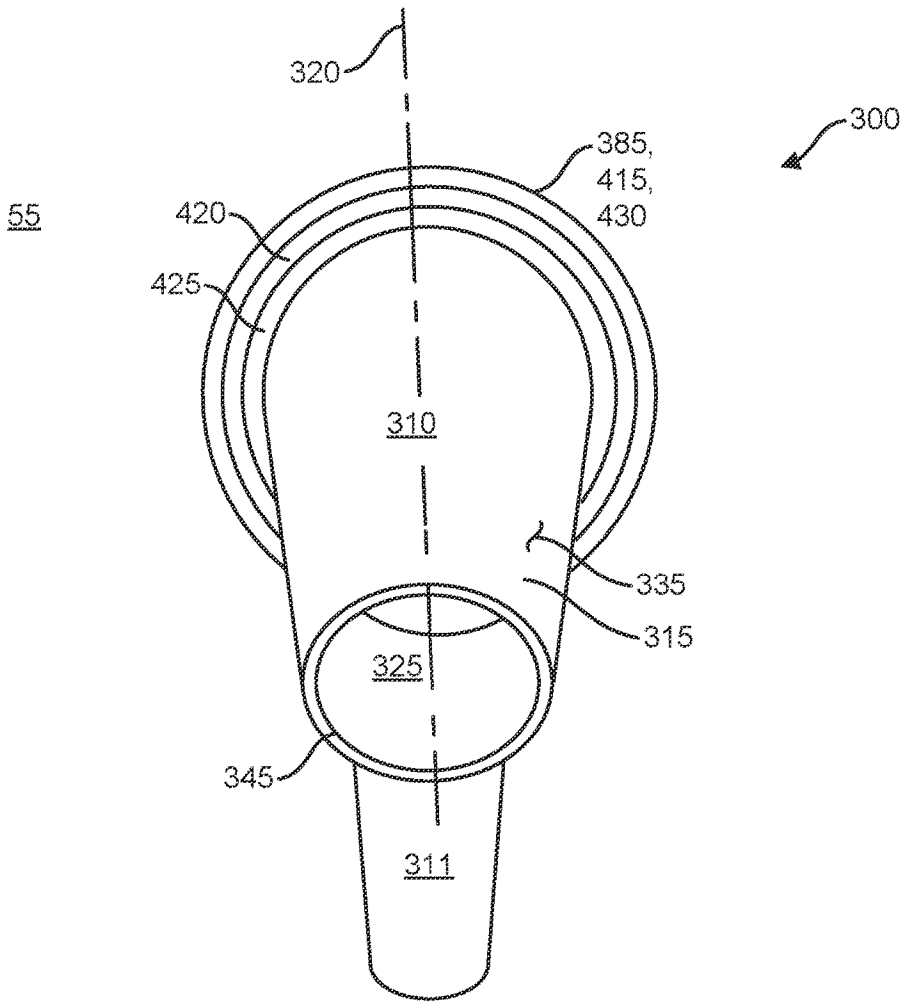
FIG. 7 shows a front or outlet perspective view of the alternate hair dryer apparatus that includes the housing, the handle, the alternate outlet portion of the alternate surrounding sidewall, and the alternate suction shroud showing the alternate annular aperture.

Next, FIG. 7 shows a front or outlet perspective view of the alternate hair dryer apparatus 300 that includes the alternate housing 310, the handle 311, the alternate outlet portion 345 of the alternate surrounding sidewall 315, and the alternate suction shroud 385 showing the alternate annular aperture 425.

Figure 8:
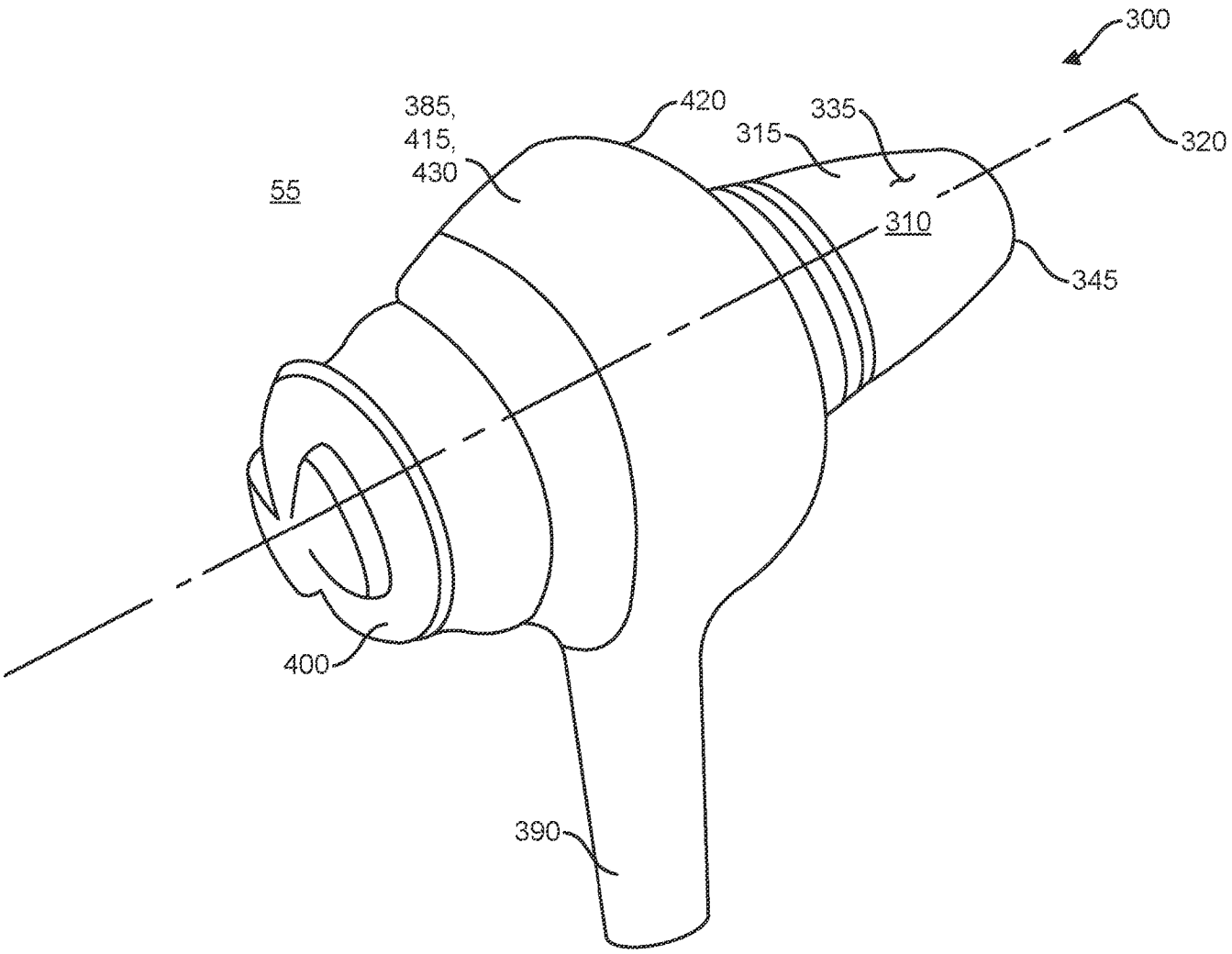
FIG. 8 shows a rear perspective view of the alternate hair dryer apparatus that includes the alternate housing, the handle, the alternate outlet portion of the alternate surrounding sidewall, and the alternate suction shroud.

Continuing, FIG. 8 shows a rear perspective view of the alternate hair dryer apparatus 300 that includes the alternate housing 310, the handle 390, the alternate outlet portion 345 of the alternate surrounding sidewall 315, and the alternate suction shroud 385.

Figure 9:
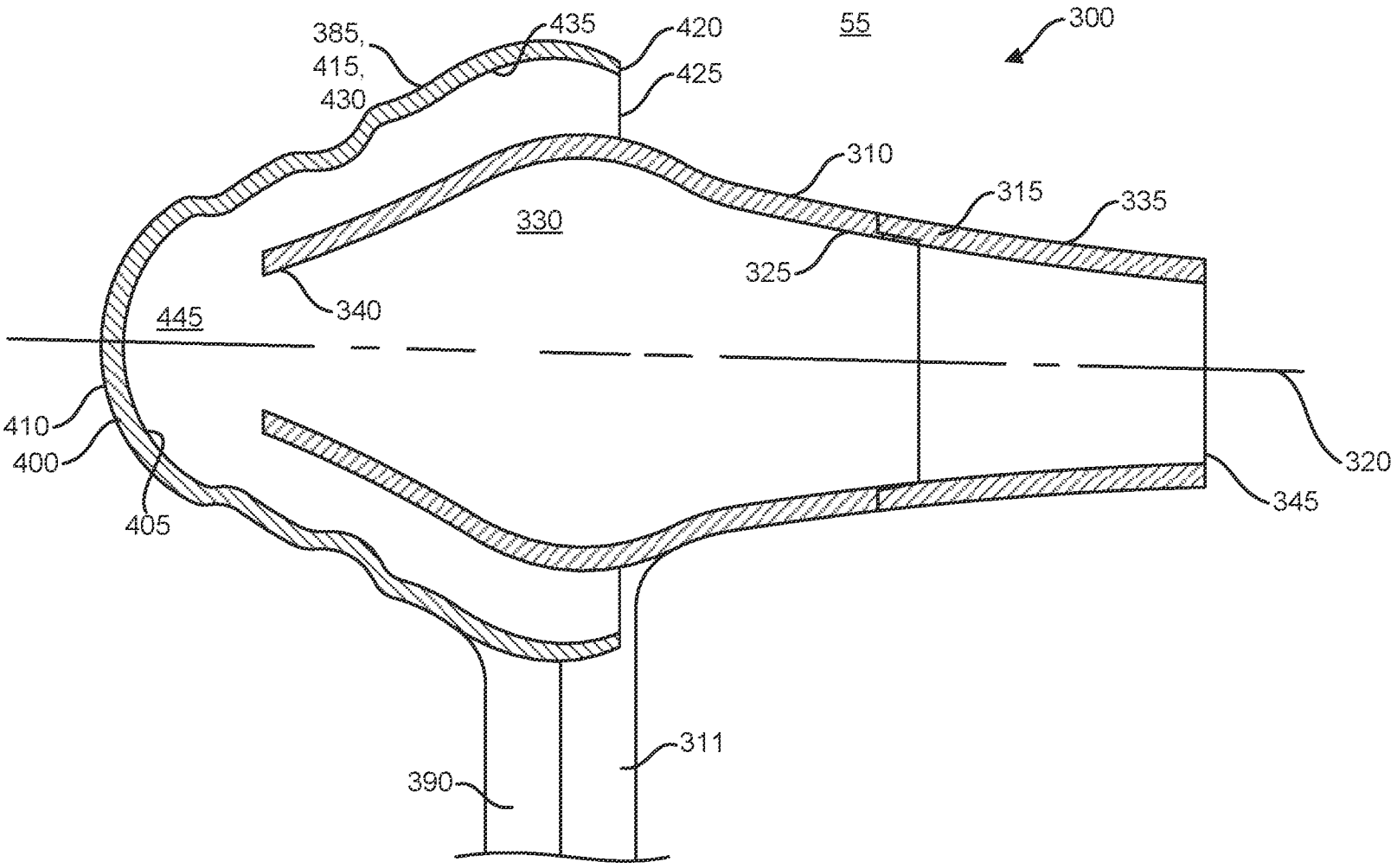
FIG. 9 shows a side elevation view of the alternate hair dryer apparatus in cross section that includes the alternate housing, the handle, the alternate outlet portion of the alternate surrounding sidewall, and the alternate suction shroud showing the alternate annular aperture.

Moving ahead, FIG. 9 shows a side elevation view of the alternate hair dryer apparatus 300 in cross section that includes the alternate housing 310, the handle 311, 390, the alternate outlet portion 345 of the alternate surrounding sidewall 315, and the alternate suction shroud 385 showing the alternate annular aperture 425.

Figure 10:
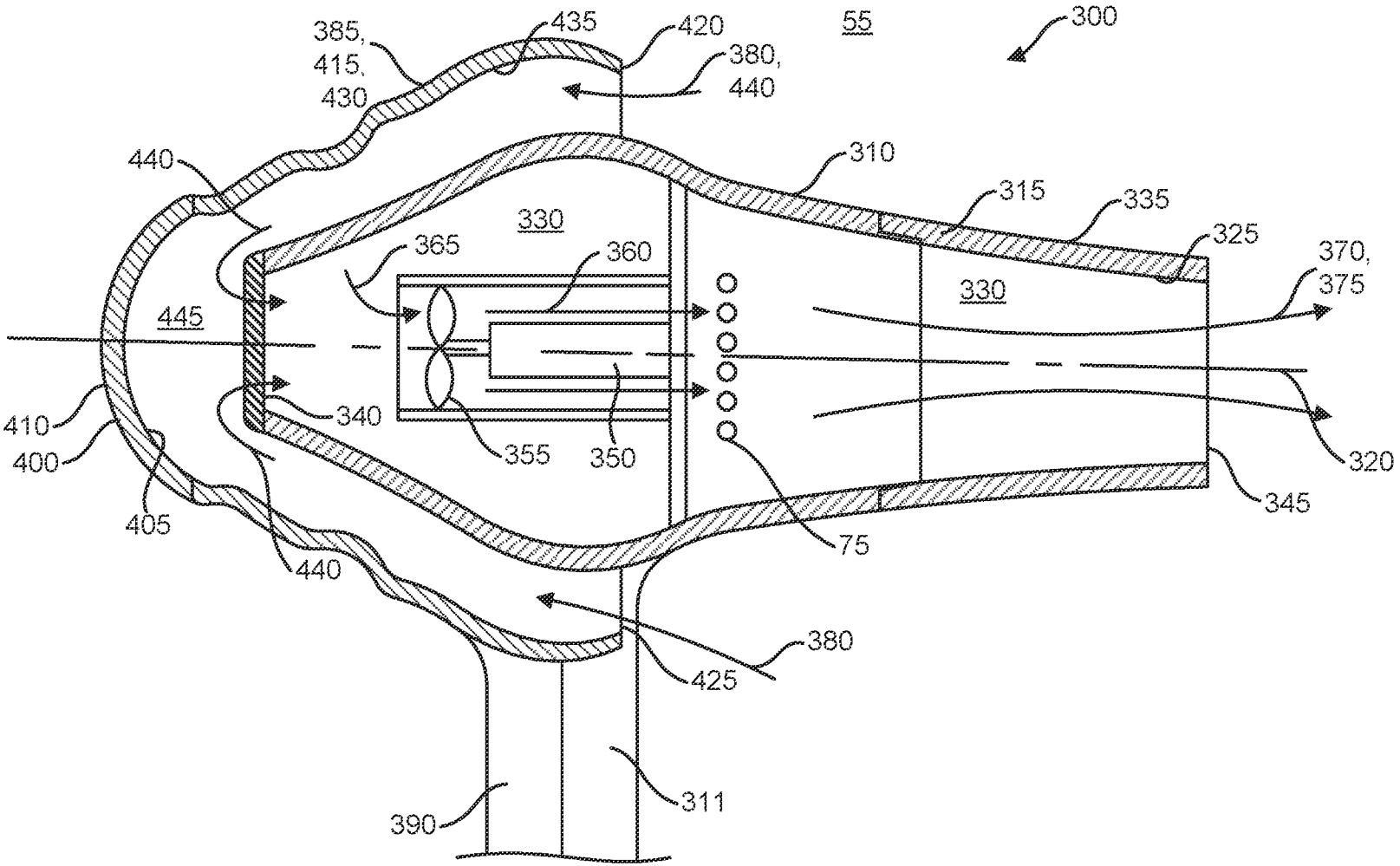
FIG. 10 shows a side elevation view of the alternate hair dryer apparatus in cross section that includes the alternate housing, the handle, the alternate outlet portion of the alternate surrounding sidewall, and the alternate suction shroud showing the alternate annular aperture, further shown is the alternate motor, the alternate blower, and the heater element, also the alternate flow path is shown.

Further, FIG. 10 shows a side elevation view of the alternate hair dryer apparatus 300 in cross section that includes the alternate housing 310, the handle 311, 390, the alternate outlet portion 345 of the alternate surrounding sidewall 315, and the alternate suction shroud 385 showing the alternate annular aperture 425, further shown is the alternate motor 350, the alternate blower 355, and the heater element 75, also the alternate flow path is shown 440.

Figure 11:
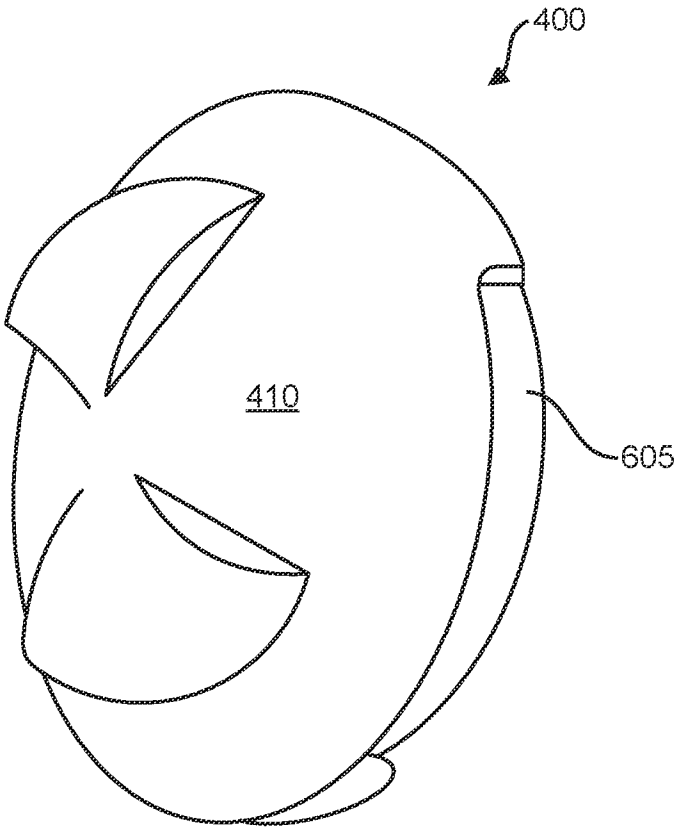
FIG. 11 shows a perspective view of the alternate solid base outer face that inserts into the alternate suction shroud as shown in FIG. 10.
Figure 12:
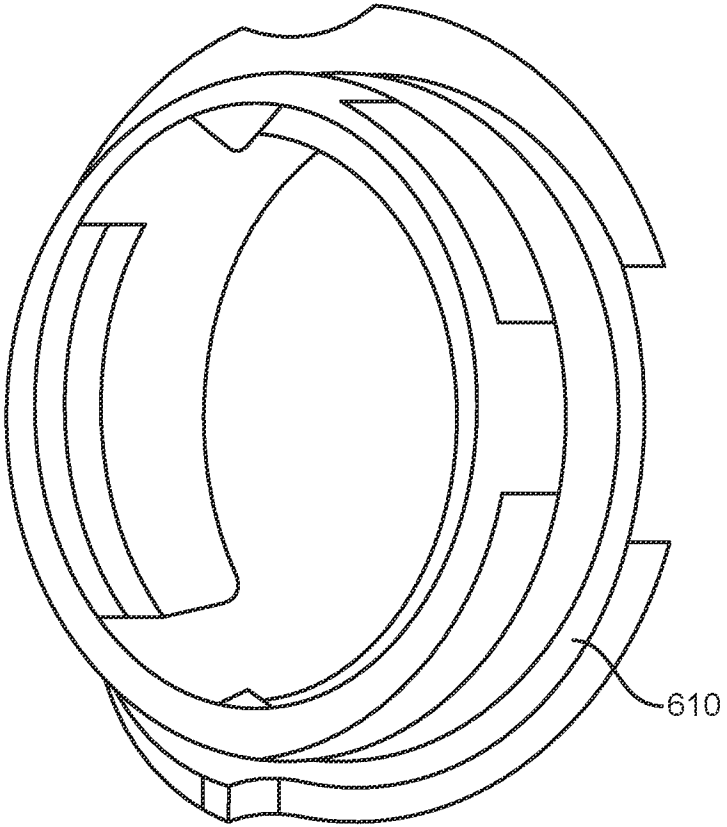
FIG. 12 shows a perspective view of the intermediate connection ring that is disposed between the solid base and the alternate suction shroud as partially shown in FIG. 13.
Figure 13:
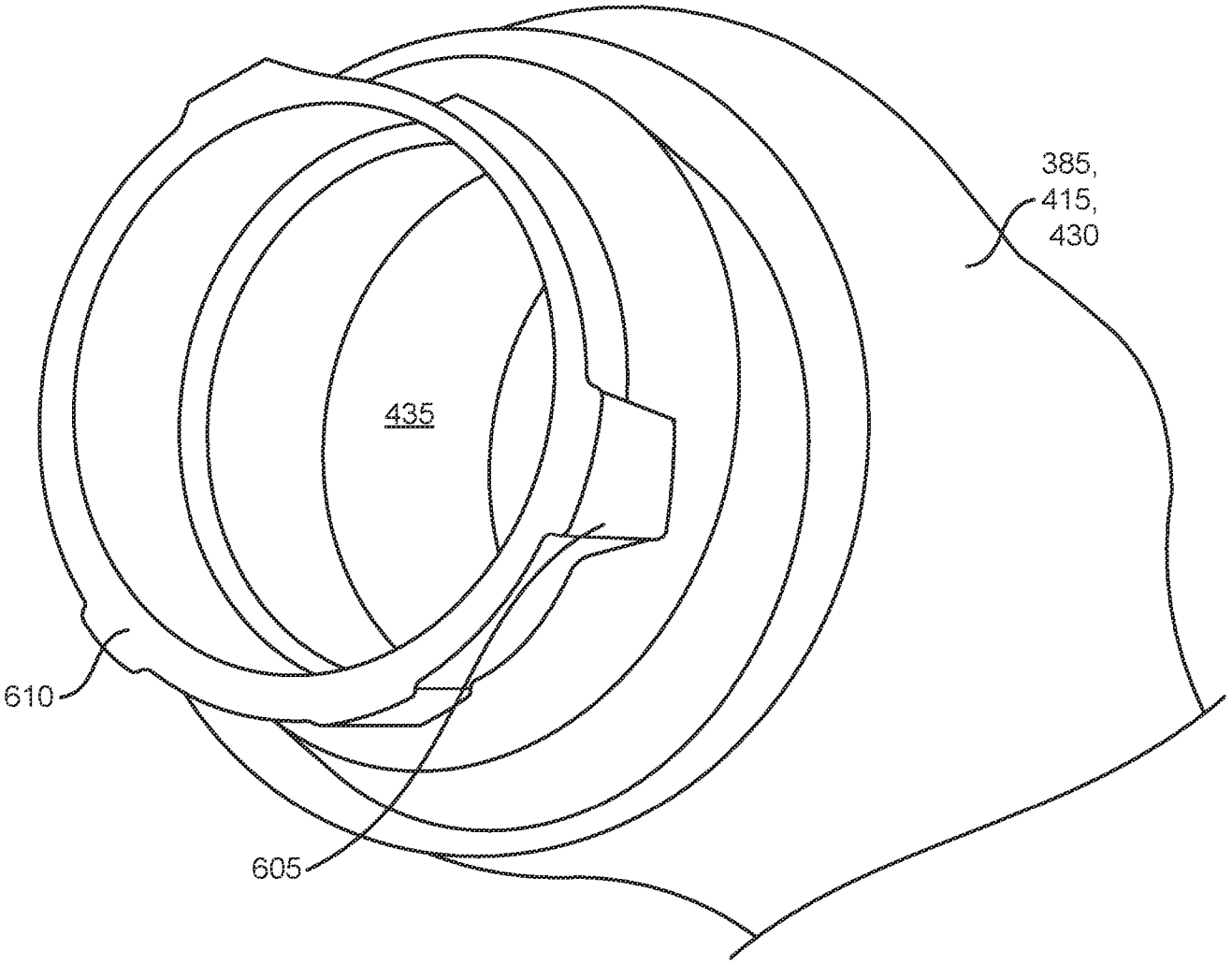
FIG. 13 shows a perspective view of the intermediate connection ring that is disposed adjacent to the alternate suction shroud.

Next, FIG. 11 shows a perspective view of the alternate solid base 400 outer face 410 that inserts into the alternate suction shroud 385 as shown in FIG. 10;

Continuing, FIG. 12 shows a perspective view of the intermediate connection ring 610 that is disposed between the solid base 400 and the alternate suction shroud 385 as partially shown in FIG. 13;

Next, FIG. 13 shows a perspective view of the intermediate connection ring 610 that is disposed adjacent to the alternate suction shroud 385.

Figure 14:
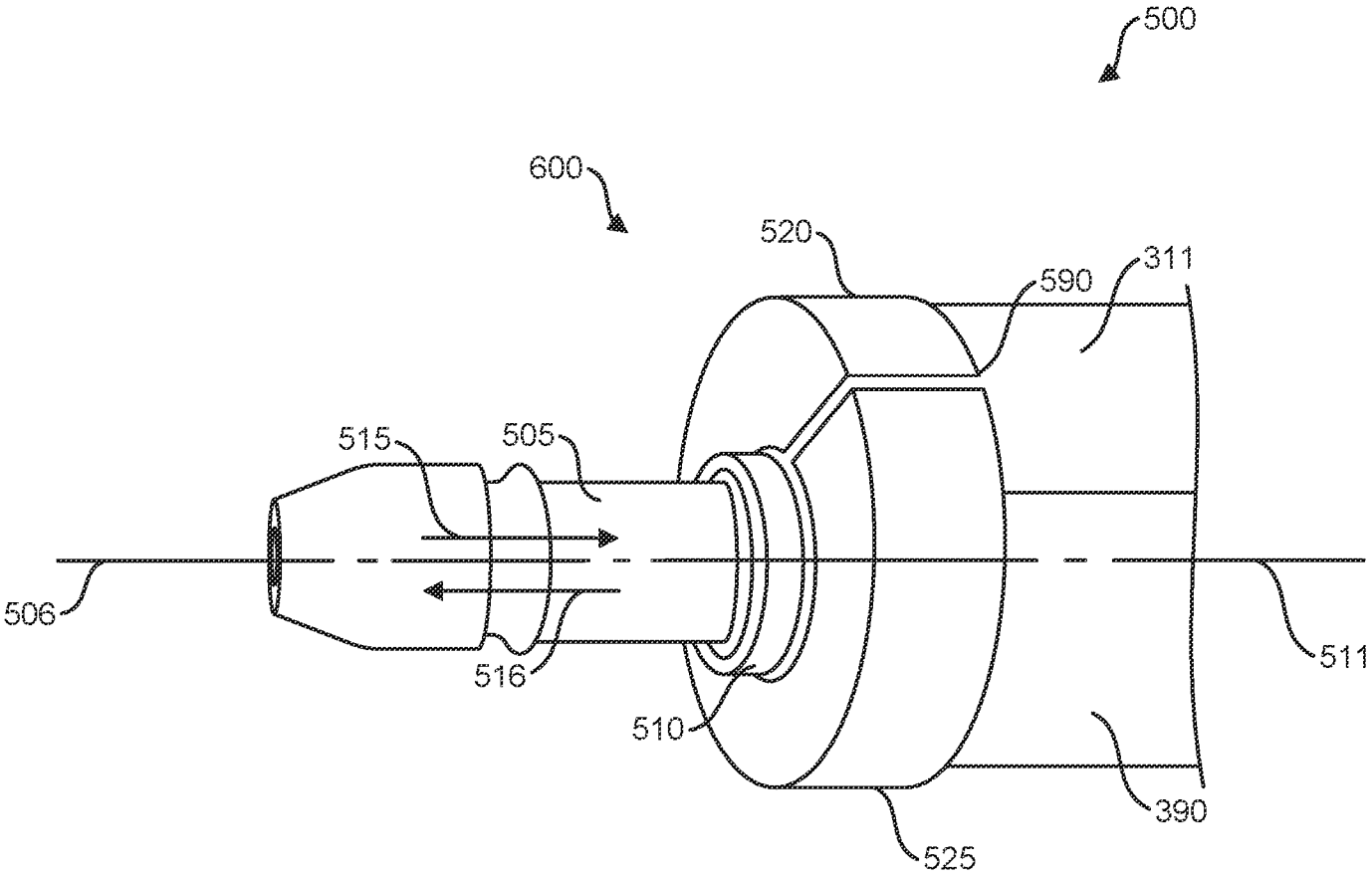
FIG. 14 shows a perspective view of the removable engagable electrical plug assembly that includes the assembled state of the male insert element and the female receptacle element.

Moving onward, FIG. 14 shows a perspective view of the removable engagable electrical plug assembly 500 that includes the assembled state 600 of the male insert element 505 and the female receptacle element 510.

Figure 15:
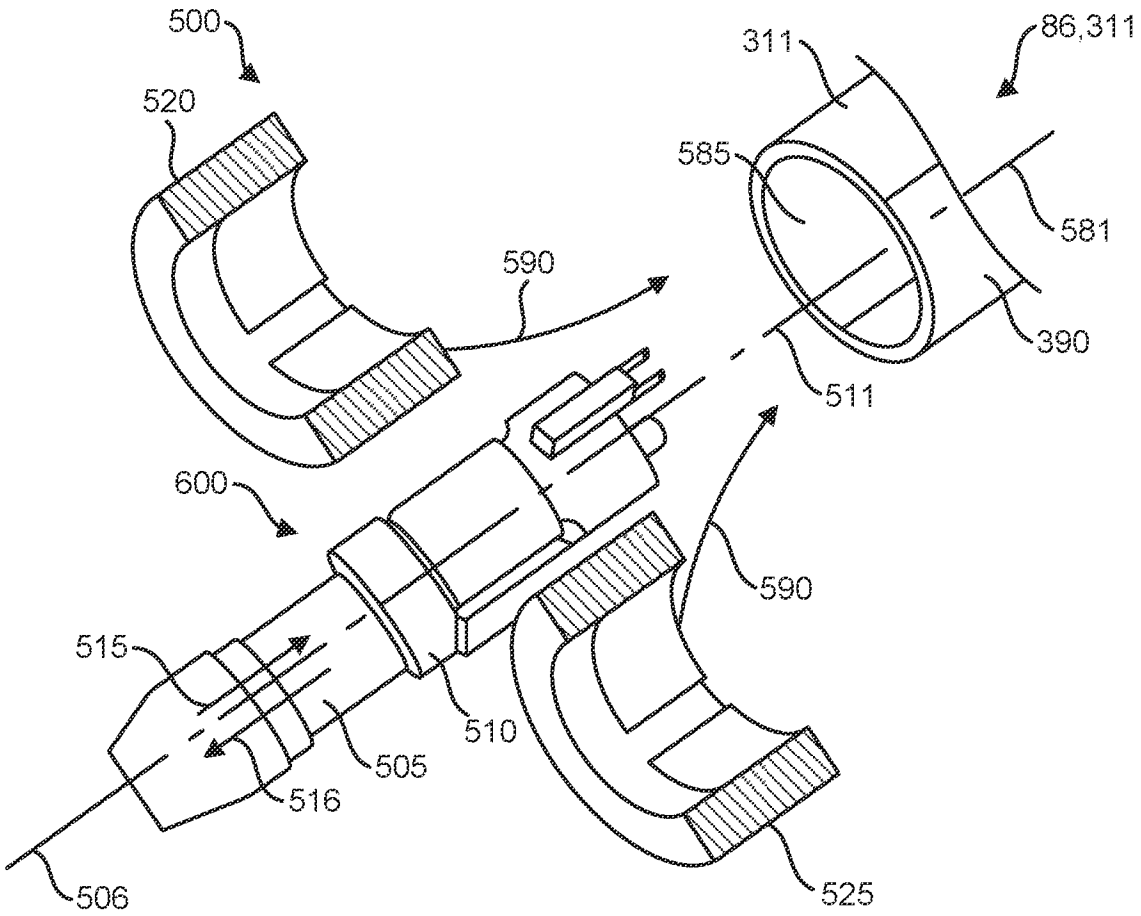
FIG. 15 shows a perspective view of the removable engagable electrical plug assembly that includes the disassembled state of the male insert element and the female receptacle element with the first and second clamshell retainers separated and showing the insert axial movement.

Continuing, FIG. 15 shows a perspective view of the removable engagable electrical plug assembly 500 that shows the disassembled state of the male insert element 505 and the female receptacle element 510 with the first 520 and second 525 clamshell retainers separated and showing the insert axial movement 515, 516.

Figure 16:
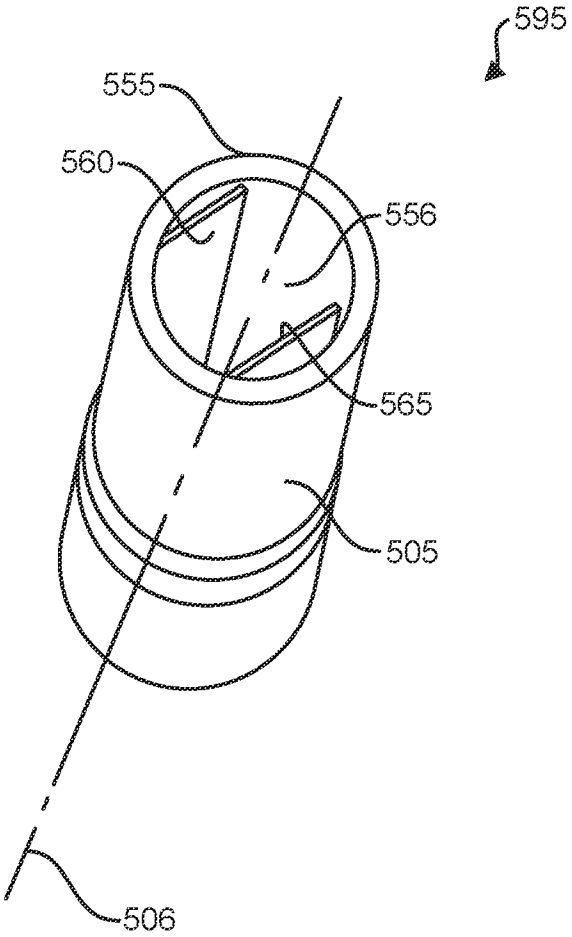
FIG. 16 shows a perspective view of the separated male insert element showing the male cylinder with the first and second male electrically conductive elements disposed within the male cylinder.

Next, FIG. 16 shows a perspective view of the separated male insert element 505 showing the male cylinder 555 with the first 560 and second 565 male electrically conductive elements disposed within the male cylinder 555.

Figure 17:
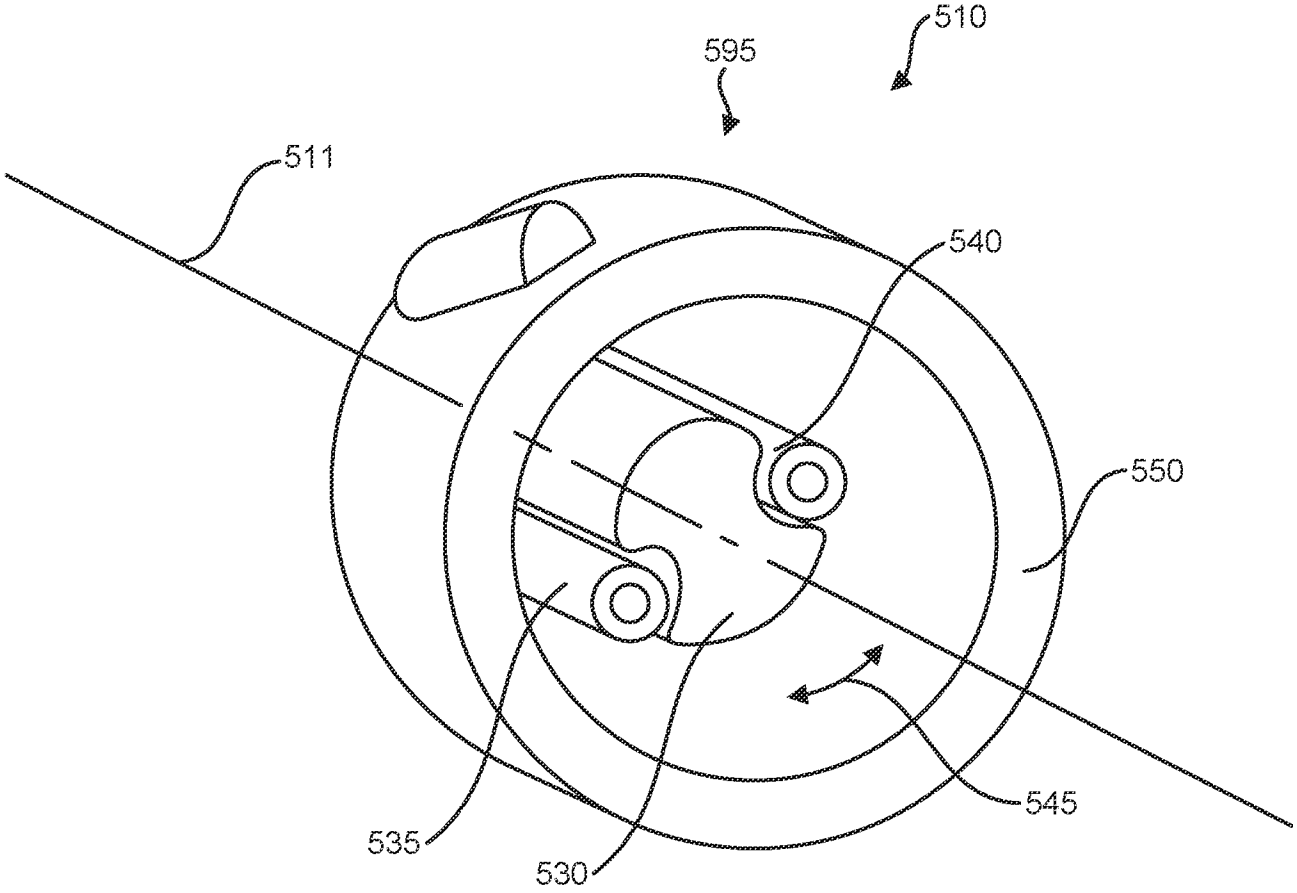
FIG. 17 shows a perspective view of the separated female receptacle element showing the female cylinder with the protrusion supporting the first and second female electrically conductive elements disposed on the protrusion.

Continuing, FIG. 17 shows a perspective view of the separated female receptacle element 510 showing the female cylinder 550 with the protrusion 530 supporting the first 535 and second 540 female electrically conductive elements disposed on the protrusion 540, with the female annular cavity 545 also shown.

Figure 18:
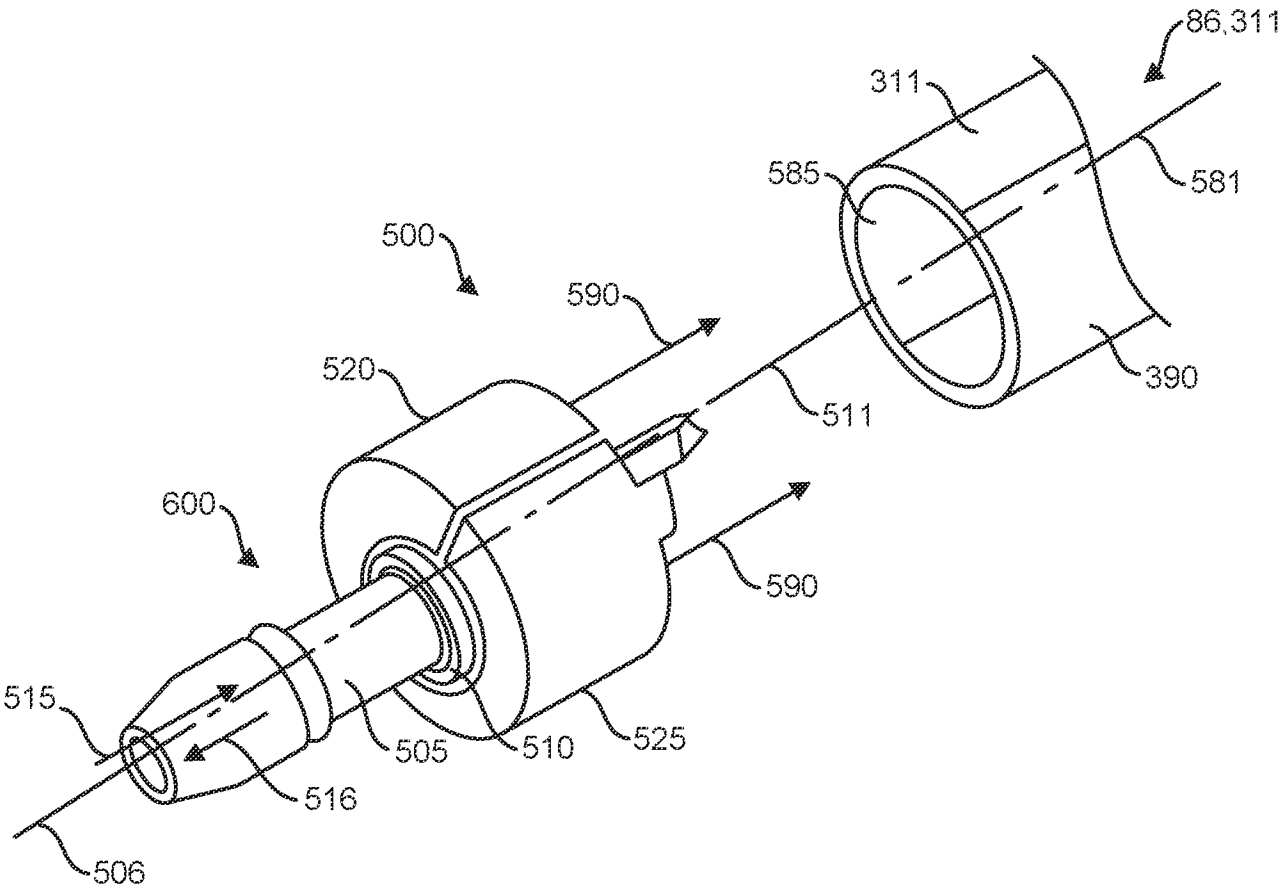
FIG. 18 shows a perspective view of the removable engagable electrical plug assembly that includes the assembled state of the male insert element and the female receptacle element with the first and second clamshell retainers that are to be assembled into the inner void of the handle.

Further, FIG. 18 shows a perspective view of the removable engagable electrical plug assembly 500 that includes the assembled state 600 of the male insert element 505 and the female receptacle element 510 with the first 520 and second 525 clamshell retainers that are to be assembled 590 into the inner void 585 of the handle 311, 390.

Figure 19:
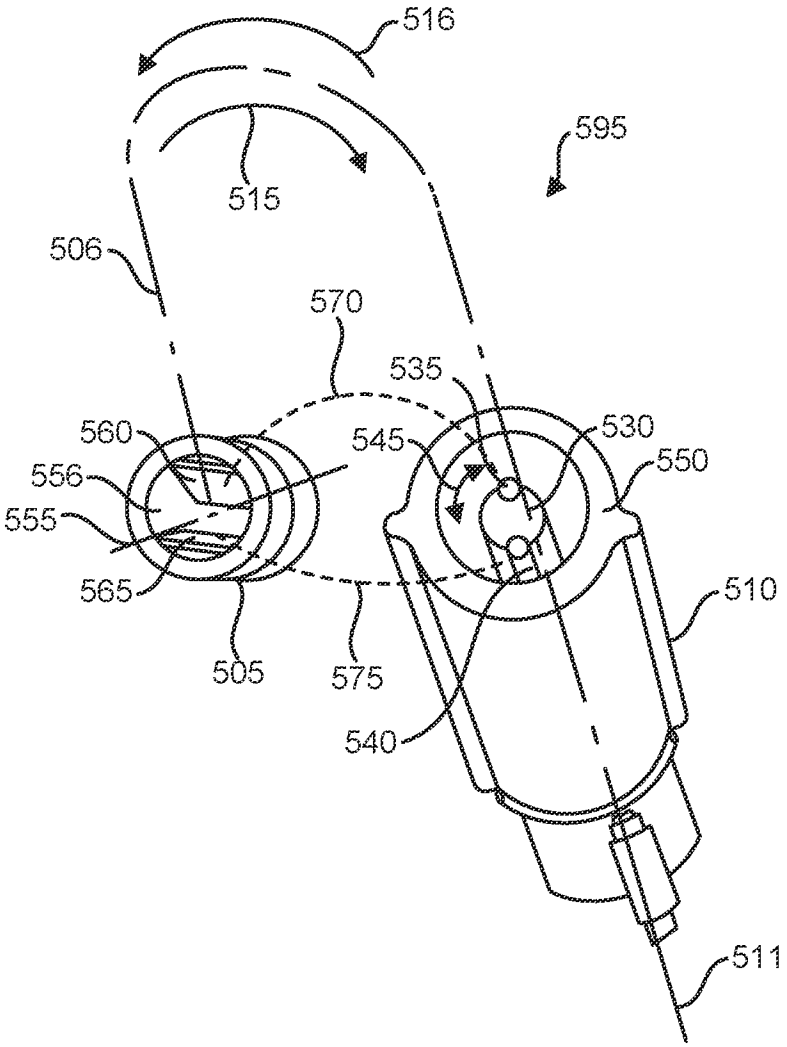
FIG. 19 shows a perspective view of the separated male insert element showing the male cylinder with the first and second male electrically conductive elements disposed within the male cylinder and the separated female receptacle element showing the female cylinder with the protrusion supporting the first and second female electrically conductive elements disposed on the protrusion with the female annular cavity wherein the insert axial movement is shown to assemble the male insert into the female receptacle wherein the first male conductive element is in electrical communication with the first female electrically conductive element and the second male conductive element is in electrical communication with the second female electrically conductive element as shown in the closed state in FIG. 14.

Continuing, FIG. 19 shows a perspective view of the separated male insert element 505 showing the male cylinder 555 with the first 560 and second 565 male electrically conductive elements disposed within the male cylinder 555 and the separated female receptacle element 510 showing the female cylinder 550 with the protrusion 530 supporting the first 535 and second 540 female electrically conductive elements disposed on the protrusion 530 within the female annular cavity 545. Further in FIG. 19 the insert axial movement 515, 516 is shown to assemble the male insert 505 into the female receptacle 510 wherein the first male conductive element 560 is in electrical communication with the first female electrically conductive element 535 and the second male conductive element 565 is in electrical communication with the second female electrically conductive element 540 as shown in the closed state in FIG. 14.

Broadly, in looking at FIGS. 1 to 19, the present invention is a hair dryer apparatus 50 that includes the housing 85 with the surrounding sidewall 90 that is about a longitudinal axis 95, the surrounding sidewall 90 having an inner surface portion 100 defining the sidewall interior 105 and the surrounding sidewall 90 having an opposing outer surface portion 110, further the surrounding sidewall 90 having an inlet portion 115 and an opposing outlet portion 120 with the longitudinal axis 95 spanning therebetween, as best shown in FIGS. 1 and 2.

Looking in particular at FIG. 2, the hair dryer apparatus 50 includes a motor 125 driven blower 130 disposed within the surrounding sidewall interior 105, the blower 130 is operational to drive airflow 131 forming an air suction 132 from the inlet portion 115 therethrough the sidewall interior 105 to the outlet portion 120 forming an air discharge 140.

Looking in particular at FIGS. 1, 2, and 3, the hair dryer apparatus 50 includes a suction shroud 150 that includes a solid base 155 with an outer surrounding sidewall 160 extending from the base 155, wherein the outer surrounding sidewall 160 has an outer termination portion 165 that is scarfed 170 such that said outer termination portion 165 extends from the base 155 to offset lengths. Further included is an inner surrounding sidewall 180 that is positioned to be inwardly adjacent to the outer surrounding sidewall 160 to form a gap 185 as between the inner 180 and outer 160 surrounding sidewalls that is fixed by a guide vane 190 affixed and disposed as between the inner 180 and outer 160 surrounding sidewalls, the inner surrounding sidewall 180 has an inner termination portion 195 that substantially matches the outer termination portion in a profile 200. Also the inner surrounding sidewall 180 extends to an annular termination portion 205 in an opposite direction to the inner termination portion 195, the annular termination portion 205 forms an annular channel 210 with the solid base 155 and an aperture 215 defined by an inner margin, wherein the inner margin is attached to the inlet portion 115 such that the annular channel 210 is to facilitate fluid communication 220 from the gap 185, to the annular channel 210, to the inlet portion 115 to operationally redirect the air suction 135 about one-hundred and eighty (180) degrees toward the outlet portion 120 to re-direct air suction noise away from the inlet portion 115 to reduce air suction noise for a user 60 facing the inlet portion 115 during use of the hair dryer 50 and to reduce the chance of user 60 hair entanglement 70 with the air suction being directed away from the housing inlet portion 115 toward the housing outlet portion 120.

Looking at FIGS. 4 to 13, the alternate hair dryer apparatus 300 is shown comprising the alternate housing 310 having the handle first portion 311 extending from the alternate housing 310, the alternate housing 310 also including at the alternate surrounding sidewall 315 being about the alternate longitudinal axis 320, the alternate surrounding sidewall 315 having the alternate inner surface portion 325 defining the alternate sidewall interior 330 and the alternate surrounding sidewall 315 having the opposing alternate outer surface portion 335, the alternate surrounding sidewall 315 having an alternate inlet portion 340 and an opposing alternate outlet portion 345 with the alternate longitudinal axis 320 spanning therebetween.

Looking at FIG. 10, for the alternate hair dryer apparatus 300, also included is the alternate motor 350 driven blower 355 disposed within the alternate surrounding sidewall interior 330, the alternate blower 355 is operational to drive alternate airflow 360 forming an alternate air suction 365 from the alternate inlet portion 340 therethrough the alternate sidewall interior 330 to the alternate outlet portion 345 forming an alternate air discharge 375.

Looking back at FIGS. 4 to 13, the alternate hair dryer apparatus 300 includes the an alternate suction shroud 385 that includes the handle second portion 390 extending from the alternate suction shroud 385, wherein the handle first 311 and second 390 portions are affixed to one another to position the alternate housing 310 and the alternate suction shroud 385 to one another the alternate suction shroud 385 also including the alternate solid base 400 having the alternate solid base inner face 405 and the alternate solid base outer face 410, further the alternate suction shroud 385 includes the alternate outer surrounding sidewall 415 extending from the alternate solid base 400. Wherein the alternate solid outer surrounding sidewall 415 has an alternate outer termination portion 420 that forms the alternate partial annular aperture 425 opening that is defined by the alternate outer termination portion 420 and the alternate outer surface portion 335, further included in the alternate outer surrounding sidewall 315 is the alternate outer boundary 430 and opposing alternate inner boundary 435, wherein the alternate annular flow path 440 is formed between the alternate inner boundary 435 and the alternate outer surface portion 335. Also the alternate annular flow path 440 initiates at the alternate partial annular aperture opening 425 and continues to the alternate inlet portion 340 wherein the alternate inner boundary 435 continues to the alternate solid base 400 inner face 405 forming an alternate inlet chamber 445, thus the alternate annular flow path 440 and the alternate inlet chamber 445 operationally redirect the air suction 440 about one-hundred and eighty (180) degrees toward the alternate outlet portion 345 to re-direct air suction noise away from the alternate inlet portion 340 to reduce air suction noise for a user 60 facing the alternate inlet portion 340 during use of the alternate hair dryer apparatus 300 and to reduce the chance of user 60 hair entanglement 70 with the air suction being directed away 380, 440 from the alternate inlet portion 340 toward the alternate outlet portion 345.

Looking at FIGS. 14 to 19, the electrical appliance 500 includes the handle 311, 390 having a longwise axis 581, the handle 311, 390 including a distal end portion 580 with an inner void 585 disposed within, further the removably engagable electrical plug assembly 500 includes the female receptacle element 510 having the female receptacle axis 511, the female receptacle element 510 includes the protrusion 530 centered on the female receptacle axis 511, the protrusion 530 includes the first female electrically conductive element 535 and the second female electrically conductive element 540. Further included is the female cylinder 550 that is about the female receptacle axis 511, wherein the female cylinder 550 defines the female annular cavity 545 with the protrusion 530, wherein the female annular cavity 545 is about the female receptacle axis 511.

Also the removably engagable electrical plug assembly 500 includes the male insert element 505 having the male receptacle axis 506, the male insert element 505 includes the male cylinder 555 that is about the male receptacle axis 506, the male cylinder 555 forms the male cavity 556 with the first male electrically conductive element 560 and the second male electrically conductive element 565 both disposed within the male cylinder 555. Wherein when the female 510 and male 505 receptacles in going from the separated state 595 to the assembled state 600 make coincident the male 506 and female 511 receptacle axes and the male cylinder 555 is received into the female annular cavity 545 wherein the male cavity 556 received the protrusion 530, this results in a first electrical communication 570 conductor contact between the first female electrically conductive element 535 and the first male electrically conductive element 560 and the second electrical communication 575 conductor contact between the second female electrically conductive element 540 and the second male electrically conductive element 565.

Also, the removably engagable electrical plug assembly 500 includes the first clam shell retainer 520 and the second clam shell retainer 525, wherein the first 520 and second 525 clam shell retainers encapsulate 600 the female receptacle element 510 within the handle 311, 390 distal 580 inner void 585 via friction to retain the female receptacle element 510 to the handle 311, 390.

CONCLUSION

Accordingly, the present invention of a hair dryer apparatus has been described with some degree of particularity directed to the embodiments of the present invention. It should be appreciated, though; that the present invention is defined by the following claim construed in light of the prior art so modifications or changes may be made to the exemplary embodiments of the present invention without departing from the inventive concepts contained therein.

The invention claimed is:

1. A hair dryer apparatus comprising:

(a) a housing including a surrounding sidewall being about a longitudinal axis, said surrounding sidewall having an inner surface portion defining a sidewall interior and said surrounding sidewall having an opposing outer surface portion, said surrounding sidewall having an inlet portion and an opposing outlet portion with said longitudinal axis spanning therebetween;

(b) a motor driven blower disposed within said surrounding sidewall interior, said blower is operational to drive airflow forming an air suction from said surrounding sidewall inlet portion therethrough said sidewall interior to said surrounding sidewall outlet portion forming an air discharge; and (c) a suction shroud that includes a solid base with an outer surrounding sidewall extending from said base, wherein said outer surrounding sidewall has an outer termination portion that is scarfed such that said outer termination portion extends from said base to offset lengths, further included is an inner surrounding sidewall that is positioned to be inwardly adjacent to said outer surrounding sidewall to form a gap as between said inner and outer surrounding sidewalls that is fixed by a guide vane affixed and disposed as between said inner and outer surrounding sidewalls, said inner surrounding sidewall has an inner termination portion that substantially matches said outer surrounding sidewall outer termination portion in a profile, further said inner surrounding sidewall extends to an annular termination portion in an opposite direction to said inner surrounding sidewall inner termination portion, said annular termination portion forms an annular channel with said solid base and an aperture defined by an inner margin, wherein said inner margin is attached to said surrounding sidewall inlet portion such that said annular channel to facilitate fluid communication from said gap, to said annular channel, to said inlet portion to operationally redirect the air suction about one-hundred and eighty (180) degrees toward said surrounding sidewall outlet portion to re-direct air suction noise away from said surrounding sidewall inlet portion to reduce air suction noise for a user facing said surrounding sidewall inlet portion during use of said hair dryer apparatus and to reduce user hair entanglement with said air suction being directed away from said surrounding sidewall inlet portion toward said surrounding sidewall outlet portion.

2. An alternate hair dryer apparatus comprising:

(a) an alternate housing having a handle first portion extending from said alternate housing, said alternate housing also including an alternate surrounding sidewall being about an alternate longitudinal axis, said alternate surrounding sidewall having an alternate inner surface portion defining an alternate sidewall interior and said alternate surrounding sidewall having an opposing alternate outer surface portion, said alternate surrounding sidewall having an alternate inlet portion and an opposing alternate outlet portion with said alternate longitudinal axis spanning therebetween;

(b) an alternate motor driven blower disposed within said alternate surrounding sidewall interior, said alternate blower is operational to drive alternate airflow forming an alternate air suction from said alternate surrounding sidewall alternate inlet portion therethrough said alternate sidewall interior to said alternate surrounding sidewall alternate outlet portion forming an alternate air discharge; and (c) an alternate suction shroud that includes a handle second portion extending from the alternate suction shroud, wherein said handle first and second portions are affixed to one another to position said alternate housing and said alternate suction shroud to one another, said alternate suction shroud also including an alternate solid base having an alternate solid base inner face and an alternate solid base outer face, further said alternate suction shroud includes an alternate outer surrounding sidewall extending from said alternate solid base, wherein said alternate outer surrounding sidewall has an alternate outer termination portion that forms an alternate partial annular aperture opening that is defined by said alternate outer termination portion and said alternate outer surface portion, further included in said alternate outer surrounding sidewall is an alternate outer boundary and opposing alternate inner boundary, wherein an alternate annular flow path is formed between said alternate inner boundary and said alternate outer surface portion, wherein said alternate annular flow path initiates at said alternate partial annular aperture opening and continues to said alternate surrounding sidewall alternate inlet portion wherein said alternate inner boundary continues to said alternate solid base inner face forming an alternate inlet chamber, thus said alternate annular flow path and said alternate inlet chamber operationally redirect the air suction about one-hundred and eighty (180) degrees toward said alternate surrounding sidewall alternate outlet portion to re-direct air suction noise away from said alternate surrounding sidewall alternate inlet portion to reduce air suction noise for a user facing said alternate surrounding sidewall alternate inlet portion during use of said alternate hair dryer apparatus and to reduce user hair entanglement with said air suction being directed away from said alternate surrounding sidewall alternate inlet portion toward said alternate surrounding sidewall alternate outlet portion.

3. An electrical appliance comprising:

(a) a handle having a longwise axis, said handle including a distal end portion with an inner void disposed within;

(b) a removably engagable electrical plug assembly, said electrical plug assembly includes;

(bi) a female receptacle element having a female receptacle axis, said female receptacle element includes a protrusion centered on said female receptacle axis, said protrusion includes a first female electrically conductive element and a second female electrically conductive element, further included is a female cylinder that is about said female receptacle axis, wherein said female cylinder defines a female annular cavity with said protrusion, wherein said female annular cavity is about said female receptacle axis;

(bii) a male insert element having a male receptacle axis, said male insert element includes a male cylinder that is about said male receptacle axis, said male cylinder forms a male cavity with a first male electrically conductive element and a second male electrically conductive element both disposed within said male cylinder, wherein when said female and male receptacles in going from a separated state to a assembled state make coincident said male and female receptacle axes and said male cylinder is received into said female annular cavity wherein said male cavity received said protrusion, this results in a first electrical communication conductor contact between said first female electrically conductive element and said first male electrically conductive element and a second electrical communication conductor contact between said second female electrically conductive element and said second male electrically conductive element;

(biii) a first clam shell retainer; and (biv) a second clam shell retainer, wherein said first and second clam shell retainers encapsulate said female receptacle element within said handle distal inner void via friction to retain said female receptacle element to said handle.

* * * * *